United States Patent [19]

Williams et al.

[11] Patent Number: 4,862,518

[45] Date of Patent: Sep. 5, 1989

[54] MULTI-PURPOSE BIB

[76] Inventors: Jaren M. Williams; Thomas E. Williams, both of 2509 Rosedale Pl., Bossier City, La. 71111

[21] Appl. No.: 182,731

[22] Filed: Apr. 18, 1988

[51] Int. Cl.[4] ..... A41D 11/00; A41C 13/10

[52] U.S. Cl. ..... 2/49 R

[58] Field of Search ..... 2/48, 49 R, 49 A, 50; 446/28

[56] References Cited

U.S. PATENT DOCUMENTS

| | | | |
|---|---|---|---|
| Des. 231,810 | 6/1974 | Daley | 2/481 XR |
| 1,963,130 | 6/1934 | Hall | 2/49 R |
| 2,635,243 | 4/1953 | Eskey | 2/49 R |
| 2,830,297 | 4/1958 | Sabee | 2/49 R |
| 2,838,758 | 6/1958 | Townley | 2/49 R |
| 3,016,544 | 1/1962 | Pinkney | 2/49 |
| 3,146,465 | 9/1964 | Hummel | 2/49 R |
| 3,629,865 | 12/1971 | Weiner | 2/48 |
| 3,777,310 | 12/1973 | Yang | 2/48 |
| 4,620,323 | 11/1986 | Tepper | 2/49 R |
| 4,660,225 | 4/1987 | Kahn | 2/49 R |

FOREIGN PATENT DOCUMENTS

| | | | |
|---|---|---|---|
| 1370116 | 7/1964 | France | 2/49 R |
| 205217 | 10/1923 | United Kingdom | 2/49 R |
| 2087223 | 5/1982 | United Kingdom | 2/49 R |

*Primary Examiner*—Jeanette E. Chapman
*Attorney, Agent, or Firm*—John M. Harrison

[57] ABSTRACT

A multi-purpose bib for infants and children which includes a generally triangular-shaped, scarf-like panels constructed of a flexible fabric material such as terry-cloth having an optional applique stitched or otherwise attached to the lower frontal area thereof. In a preferred embodiment, opposite apex portions of the bib are fitted with connecting loop and pile elements, respectively, of a loop-pile fastener and the third, downwardly-extending apex portion of the bib receives the optional applique. Accordingly, the bib is capable of being placed around an infant's neck with the loop and pile elements attached and the applique facing outwardly. The bib can then be shaped to flatten the top margin of frontal neck portion between the two fastening apex portions, in order to capture saliva. Furthermore, the downwardly-extending apex of the bib can be turned upwardly in a fold which retains the apex in an upwardly and outwardly-extending configuration. The applique may be provided above the apex of the bib, wherein the fold either creases the applique or extends across the bib immediately above the applique, with the applique acting as a stiffening member, to catch food particles while the infant is eating.

10 Claims, 1 Drawing Sheet

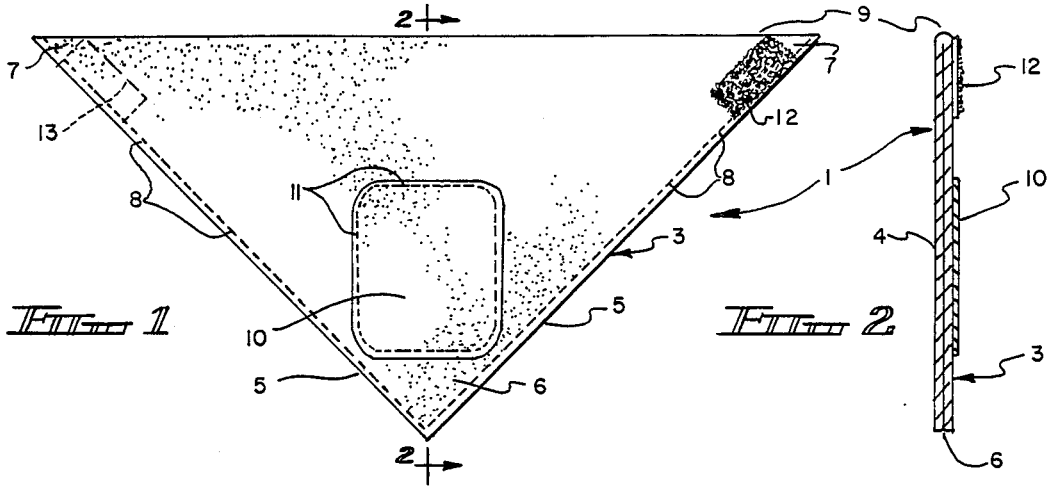
FIG. 1
FIG. 2
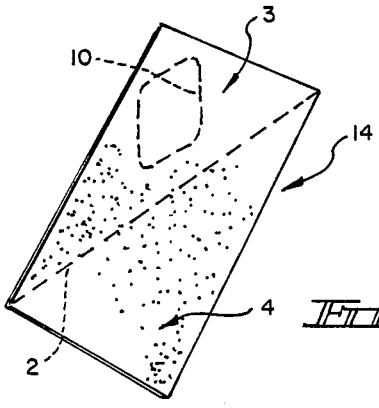
FIG. 3
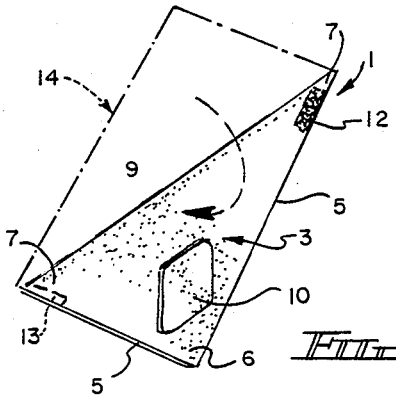
FIG. 4
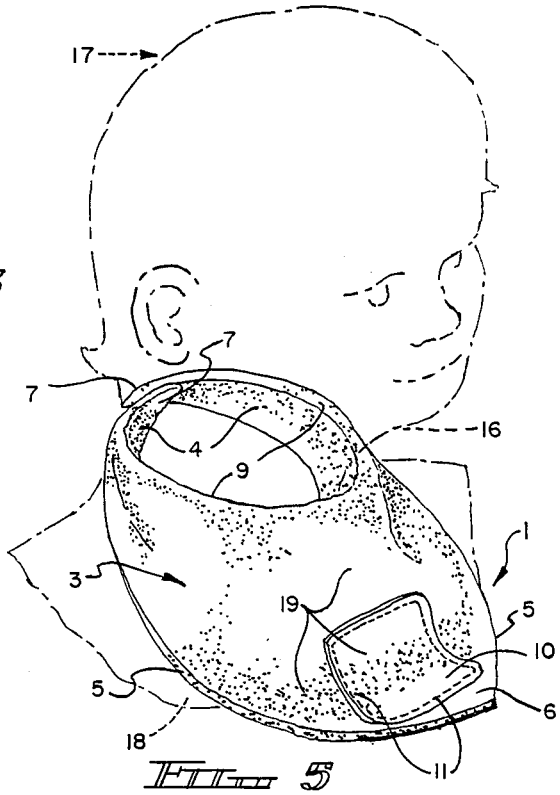
FIG. 5
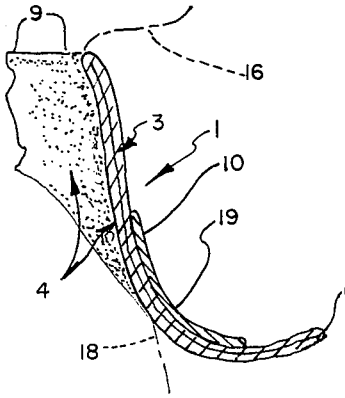
FIG. 6
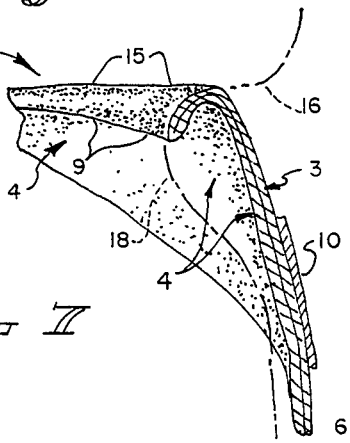
FIG. 7

MULTI-PURPOSE BIB

BACKGROUND OF THE INVENTION

1. Field of the Invention

This invention relates to bibs for infants and children and more particularly, to a multi-purpose bib which is shaped from a flexible cloth material such as terrycloth and is characterized by a generally triangular scarf or bandanna-shaped configuration, with an optional applique of desired shape and size provided at the bottom apex of the bib. In a preferred embodiment, the oppositely-disposed side apexes each contain a connecting element of a loop-pile fastener for fastening the bib around an infant's neck. The bib is designed not only to protect the baby's clothing while eating and playing, but also to catch and absorb saliva from the baby's mouth by inward adjustment of the top margin of the bib against the baby's neck and to collect spilled food particles by folding the bottom apex of the triangular-shaped bib upwardly while the child is eating. The bib is designed for conventional laundering and various decorative design material and indicia can be placed on appliques of selected size and shape, which may be applied by heat, sewn, or stitched to the downwardly-extending frontal portion of the bib above the bottom apex. The multi-purpose bib is typically constructed from a square terrycloth washcloth of selected size, which is folded diagonally from corner-to-corner to define a triangular-shaped, absorbent, double-layer, protective bib element. The bib may be fitted to the neck of an infant or child using conventional closures such as snaps, buttons or ties, instead of using the loop-pile fastener, as desired. The optional applique serves both as a decorative element and to help stiffen the lower portion or downwardly-extending bottom apex of the bib and facilitates folding of the bottom apex upwardly in a trough-shaped configuration across or immediately above the applique, to catch spilled food particles while the baby is eating.

One of the problems which is widely recognized in feeding infants, babies and small children and teaching them to eat independently of feeding by others, is that of dropping, spilling and scattering food. Another problem, particularly in the case of smaller infants, is that of salivating or "drooling", which results in the wetting and staining of clothing, particularly around the neck portion of the clothing.

2. Description of the Prior Art

Various types of neckwear have been devised in order to prevent or at least minimize the problem of staining infant and baby clothing due to salivating and spilling food, many of which take the form of bibs which are tied, snapped or buttoned behind the baby's neck, in order to protect the front portion of the clothing. Some of these bibs are shaped from plastic materials with a permanent upward-turned lip provided at the bottom for catching the food particles when the infant or child is eating. These plastic bibs are normally relatively inflexible, are easily split or torn and must be washed with a sponge or a washcloth after each meal.

U.S. Pat. No. 3,857,116, dated Dec. 31, 1974, to Donald W. Meeker, details a "Method of Making Towel Bibs", which method entails fabricaion of bibs from rectangular sheets of absorbent material. The bibs are characterized by a rectangular opening in the top edge thereof, which opening admits and encompasses the base of the neck of the wearer and provides open access to the neck. The opening is bordered on three sides by a protective flap of uniform width extending from the main body of the towel bib and folded to the back side thereof. The flap, when tucked between the clothing and skin of the wearer, serves to hold the towel bib in place and provides a shield for the neckline and underside of the clothing of the wearer, while the main body of the towel bib provides a shield for the clothing of the wearer during the performance of shaving, cleansing or other grooming operations on the face and neck of the wearer. An "Ornamental Bib" is detailed in U.S. Pat. No. 4,660,225, dated April 28, 1987, to Beatrice Kahn. The bib is constructed of a flexible fabric having a highly light-reflective coating or layer laminated on the outside surface thereof. Ambient light striking the reflective coating is directed upwardly upon the face and hair of the wearer to enhance the wearer's appearance. U.S. Pat. No. 4,719,650, dated Jan. 19, 1988, to Mary E. Milloy, details a "Pacifier Bib" which is shaped from a flat panel of fabric having a wishbone configuration. The bib includes a U-shaped collar adapted for attachment of the distal ends thereof after encirclement around the neck of a child. An integral flap extends downwardly from the collar and is adapted to have its distal end folded over into a closed loop for attaching the handle of a pacifier to the bib.

It is an object of this invention to provide a new and improved multi-purpose bib which is constructed of a flexible fabric material and is fitted with fasteners, in order to secure the bib to the neck of an infant or child, which bib is further characterized by a downwardly-extending frontal portion that may be provided with an applique for stiffening the frontal portion and facilitating easier folding of the frontal portion upwardly to trap and collect food particles.

Another object of this invention is to provide a multi-purpose, moisture-absorbent bib having a generally triangular configuration, which bib includes a downwardly-extending, flexible, tapered frontal portion adapted for upward-turning disposition when an infant or small child is fed, in order to catch spilled food particles.

Another object of this invention is to provide a generally triangular-shaped, flexible fabric bib for babies, which bib includes a loop-pile fastener for securing opposite side apexes of the triangular bib around the neck of the baby, such that the third apex projects downwardly and further including an applique of selected size and shape attached to the bib above the bottom apex, to facilitate folding the bottom apex of the bib outwardly and substantially upwardly, across or above the applique, to shape a trough in the bib for collection of spilled food particles.

A still further object of this invention is to provide a bib which is shaped in the configuration of an isosceles triangle from two layers of terrycloth or an equivalent flexible, moisture-absorbent fabric of selected thickness, which bib includes connecting elements attached to the opposite side apexes of the bib for joining the side apexes and securing the bib around a child's neck, such that the bottom apex projects downwardly and further including an optional, decorative, quilted applique which may be stitched or otherwise secured to the bib above the bottom apex, to facilitate a more efficient upward-turning of the bottom apex and securing the bottom apex in this upward-turned configuration, for capturing spilled food.

SUMMARY OF THE INVENTION

These and other objects of the invention are provided in a new and improved multi-purpose bib which is characterized by a flexible, triangular-shaped protective covering for the chest of an infant, baby or small child, with paired connecting elements of a loop-pile fastener attached to the side apexes of the bib, for removably securing the bib around the neck of the infant. In a first preferred embodiment, an applique is provided on the downwardly-extending bottom apex portion of the bib to facilitate folding of the downwardly-extending portion upwardly across or immediately above the applique, to form a trough for the collection of spilled food. In a second preferred embodiment, the protective covering is shaped into an isosceles triangle from two layers of terrycloth by folding a square terrycloth fabric sheet diagonally, such that the folded margin of the bib can be flattened and shaped to fit against the infant's neck to intercept and absorb saliva.

BRIEF DESCRIPTION OF THE DRAWING

The invention will be better understood by reference to the accompanying drawing, wherein:

FIG. 1 is a front view of a preferred embodiment of the multi-purpose bib of this invention;

FIG. 2 is a sectional view taken along line 2—2 of the multi-purpose bib illustrated in FIG. 1;

FIG. 3 is a frontal perspective view of a square, fabric bib blank for constructing the multi-purpose bib illustrated in FIG. 1;

FIG. 4 is a frontal perspective view of the bib blank illustrated in FIG. 3, folded diagonally into the configuration of the multi-purpose bib illustrated in FIG. 1;

FIG. 5 is a perspective view of the multi-purpose bib illustrated in FIG. 1, fitted in functional configuration on a child's neck and chest;

FIG. 6 is a sectional view of the multi-purpose bib illustrated in FIG. 5; and FIG. 7 is a sectional view of the multi-purpose bib illustrated in FIG. 5, with the neck margin flattened and adjusted inwardly.

DESCRIPTION OF THE PREFERRED EMBODIMENTS

Referring initially to FIGS. 1–4 of the drawing, the multi-purpose bib of this invention is generally illustrated by reference numeral 1. In a preferred embodiment of the invention, the multi-purpose bib 1 is shaped from a square bib blank 14, as further illustrated in FIGS. 3 and 4. The bib blank 14 is typically characterized by a square washcloth of suitable size, which is constructed of terrycloth or other soft, flexible fabric material that can be folded diagonally as illustrated in FIG. 4, to create the triangular-shaped, double-layer, multi-purpose bib 1. The front panel 3 of the bib blank 14 is folded on top of the rear panel 4 along the fold line 2 as illustrated in FIGS. 3 and 4, to shape the multi-purpose bib 1 into an isosceles triangle, having a bandanna configuration. The multi-purpose bib 1 is characterized by a top margin 9, which terminates at each end at a side apex 7 and side margins 5, which are of equal length and project from the side apexes 7, respectively, to converge and define a bottom apex 6. The front panel 3 and rear panel 4 are sewn together along the side margins 5 by the panel stitching 8 and no stitching is provided along the top margin 9, for reasons which will be hereinafter discussed. In another preferred embodiment of the invention, a loop element 12 is stitched or otherwise applied to one of the side apexes 7 on the front panel 3 and a companion pile element 13 is stitched or otherwise secured to the opposite side panel apex 7 on the rear panel 4, to facilitate attachment of the multi-purpose bib 1 around the neck 16 of a small child 17, as illustrated in FIG. 5. It will be appreciated by those skilled in the art that instead of the loop element 12 and pile element 13 of a conventional loop pile element, other fasteners such as buttons, snaps, ties and the like, can also be utilized to secure the multi-purpose bib 1 in functional, protective configuration around the child's neck 16, as illustrated in FIG. 5. An optional applique 10 may be secured to the front panel 3 by ironing or by means of applique stitching 11 and is located above and near the bottom apex 6 of the multi-purpose bib 1. In a most preferred embodiment of the invention, the applique 10 is substantially centered in the lower portion of the front panel 3 of the multi-purpose bib 1 immediately above the bottom apex 6 and may include various designs, colors, cartoon characters or other indicia, as desired. Furthermore, while shaped generally in the configuration of a square as illustrated in the drawing, it will be appreciated that the applique 10 can be shaped in any desired geometrical configuration, including other polygons, circles of various size, and ellipses, in non-exclusive particular. Furthermore, the applique 10 may include quilting or padding or a relat1vely thick applique material which is ideally suited to help support the downwardly-extending bottom apex 6 in upward-folded, trough-like configuration as illustrated in FIG. 6, as further hereinafter described.

Referring now to FIGS. 5 and 6 of the drawing, the multi-purpose bib 1 is secured around the neck 16 of the child 17 by connecting the cooperating loop element 12 and pile element 13, with the top margin 9 encircling the neck 16, as illustrated in FIG. 5. Because of the precise positioning of the optional applique 10 immediately above the bottom apex 6 and centered in the lower portion of the front panel 3, the bottom apex 6, lower portion of the multi-purpose bib 1 and the applique 10 are easily curved outwardly and upwardly along a fold or folds 19 which extend across the applique 10 or the top edge of the applique 10. The bottom apex 6 is supported in this trough-like position outwardly of the child's chest 18 by the stiffness of the applique 10 and the fold or folds 19, which extend across the multi-purpose bib 1, in order to receive and trap spilled food particles while the child 17 is eating. This folding of the bottom apex 6 upwardly substantially in a curve as illustrated in FIG. 5 is facilitated by extending the fold or folds 19 across the entire frontal portion of the multi-purpose bib 1 from the respective side margins 5 and utilizing the thickness of the applique 10 as a stiffening element to help maintain this outwardly and upwardly-curving configuration. While the bottom apex 6 can be folded upwardly and outwardly of the chest 18 due to the triangular shape of the multi-purpose bib 1 without the applique 10, the applique 10 greatly enhances the strength of the fold or folds and permits the collection of larger quantities of spilled food in the trough-like receptacle than would otherwise be possible.

Referring now to FIGS. 5 and 7 of the drawings, the top margin 9 of the multi-purpose bib 1 can be adjusted and flattened by manipulating the adjacent, unconnected segments of the folded front panel 3 and rear panel 4 to define an extended neck fold 15 which fits closely against the neck 16 of the infant 17, in order to catch and absorb saliva which may drip from the child's mouth onto the multi-purpose bib 1. Since the front panel 3 and the rear panel 4 are constructed of a flexible material such as terrycloth and may be displaced relative to each other at the unstitched top margin 9, the top margin 9 can be easily flattened and shaped inwardly to create and maintain the neck fold 15.

While the multi-purpose bib 1 may be constructed of a single layer of moisture-absorbent, flexible material such as terrycloth, it is most preferably shaped from a double layer of such material, as described above, for greater absorbency and flexiblity in shaping the neck fold 15, as illustrated in FIG. 7. Additional layers of the absorbent, flexible material may also be utilized to construct the multi-purpose bib 1, depending upon the degree of absorbency desired. Furthermore, while the multi-purpose bib 1 is preferably shaped in the configuration of an isosceles triangle as illustrated in the drawing, it will be appreciated that other bib configurations may also be used, such as equilaterial triangles and more conventional-shaped bibs, in non- exclusive particular.

It will be appreciated from a consideration of the multi-purpose bib of this invention that the bib offers a convenient and useful device for protecting the frontal chest portion clothing of an infant, baby or child from food and saliva stains. The multi-purpose bib is characterized by convenience, in that it can be easily laundered and requires no special cleaning, care or treatment and it is easily constructed from conventional terrycloth wash cloths. Additionally, appliques of selected size, design and ornamentation can be attached to the bib by any desired technique to enhance the appearance of the bib and facilitate a more efficient upward turning of the bib to collect spilled food, as described above.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A multi-purpose bib comprising a generally triangular-shaped body portion having at least two layers of flexible material, oppositely-disposed side apexes provided in said body portion for attachment about the neck of a wearer, a bottom apex portion extending from said body portion and applique means provided substantially in the lower center area of said bottom apex portion, said applique means adapted to bend with said bottom apex portion outwardly and upwardly with respect to the wearer's chest, into a trough-like configuration.

2. The multi-purpose bib of claim 1 further comprising a loop-pile fast having a loop element attached to one of said side apexes and a pile element said loop-pile fastener attached to the other one of said side apexes, said loop element and said pile element adapted for engagement to secure said multi-purpose bib about the neck of the wearer.

3. The multi-purpose bib of claim 1 further comprising a loop-pile fast having a loop element attached to one of said side apexes and a pile element said loop-pile fastener attached to the other one of said side apexes, said loop element and said pile element adapted for engagement to secure said multi-purpose bib about the neck of the wearer.

4. A multi-purpose bib formed from a generally triangular-shaped, multi-layer panel of substantially soft and flexible material, comprising oppositely-disposed side apexes for encirclement around a child's neck, fastening means carried by said side apexes for securing said bib around the child's neck, a bottom apex shaped in said panel, said bottom apex projecting downwardly from said side apexes when said bib is disposed on the child's neck, and applique means of selected size and configuration secured said panel in close proximity to said bottom apex, whereby said bottom apex said applique means are selectively foldable outwardly and upwardly of the child's chest to define a generally trough-like receptacle in said panel for receiving food spilled by the child.

5. The multi-purpose bib of claim 4 wherein said fastening means further comprises a loop-pile fastener having a loop element attached to one of said side apexes and a pile element of said loop-pile fastener attached to the other one of said side apexes, said loop element and said pile element adapted for engagement to secure said bib about the child's neck.

6. A multi-purpose bib for protecting a child from food spills, comprising a generally triangular-shaped, two-layer panel of substantially soft and flexible material, oppositely-disposed side apexes provided in said panel for encirclement around a child's neck, a bottom apex shaped in said panel, said bottom apex projecting downwardly from said side apexes when said bib is disposed on the child's neck and applique means secured to said panel in close proximity to said bottom apex, whereby said bottom apex and said applique means are foldable outwardly and upwardly of the child's chest to define a generally trough-shaped receptacle in said panel for receiving food spilled by the child.

7. The multi-purpose bib of claim 6 wherein said applique means further comprises a quilted applique of selected size and configuration.

8. The multi-purpose bib of claim 7 further comprising fastening means carried by said side apexes for securing said bib around the child's neck.

9. The multi-purpose bib of claim 8 wherein said fastening means further comprises a loop-pile fastener having a loop element attached to one of said side apexes and a pile element of said loop-pile fastener attached to the other one of said side apexes, said loop element and said pile element adapted for engagement to secure said bib about the child's neck.

10. The multi-purpose bib of claim 9 further comprising stitching provided along the edges of said body portion extending between said side apexes and said bottom apex, respectively, for securing said two layers of said flexible material together.

* * * * *